United States Patent [19]

Sando et al.

[11] 4,255,951

[45] Mar. 17, 1981

[54] DEVICE FOR CONTINUOUSLY IMPREGNATING CLOTH MATERIAL WITH LIQUID

[75] Inventors: Yoshikazu Sando; Hiroshi Ishidoshiro, both of Wakayama, Japan

[73] Assignee: Sando Iron Works Co. Ltd., Wakayama, Japan

[21] Appl. No.: 92,541

[22] Filed: Nov. 8, 1979

[30] Foreign Application Priority Data

Nov. 13, 1978 [JP] Japan ..... 53-139731

[51] Int. Cl.[3] ..... D06B 3/18

[52] U.S. Cl. ..... 68/22 R; 68/181 R

[58] Field of Search ..... 68/22 R, 175, 177, 178, 68/179, 181 R, 184

[56] References Cited

U.S. PATENT DOCUMENTS

| | | | |
|---|---|---|---|
| 2,533,247 | 12/1950 | Helmus | 68/181 R X |
| 3,346,893 | 10/1967 | Carpenter | 68/181 R X |
| 3,364,705 | 1/1968 | Thornber | 68/184 X |

FOREIGN PATENT DOCUMENTS

| | | | |
|---|---|---|---|
| 1460265 | 11/1971 | Fed. Rep. of Germany | 68/175 |

*Primary Examiner*—Philip R. Coe

*Attorney, Agent, or Firm*—Toren, McGeady and Stanger

[57] ABSTRACT

A device for continuously impregnating a cloth material with a dye solution or a resin liquid or the like. The device includes a tubular cloth material passage measuring at least 400 mm in length and has an opening which is slightly wider than the breadth of the cloth material in transverse width and measures about 3 mm in longitudinal width. A liquid supply mechanism adjoins the cloth material inlet of the cloth material passage; and wringer rolls are provided in the vicinity of the outlet of the cloth material passage. Within the liquid supply mechanism, a pair of weir plates is provided each of which is disposed on an opposite side of the cloth material passing through the liquid supply mechanism. The weir plates are arranged to permit the adjustment of the gap between them for allowing the cloth material to pass therethrough.

1 Claim, 8 Drawing Figures

DEVICE FOR CONTINUOUSLY IMPREGNATING CLOTH MATERIAL WITH LIQUID

BACKGROUND OF THE INVENTION

1. Field of the Invention

This invention relates to a device for continuously impregnating a cloth material homogeneously with a dye solution or a resin liquid or the like.

2. Description of the Prior Art

To continuously impregnate a cloth material with a dye solution or the like while it is on the move, the conventional liquid impregnating device for cloth materials is arranged, for example, as shown in FIG. 1 of the accompanying drawings. In the conventional device of this type, a guide roll b is disposed within a container a which has a U-shaped sectional form; a dye solution c is put in the container to have a cloth material d immersed in the dye solution c while the cloth material d is guided by the guide roll b; and there are arranged wringer rolls e to wring the cloth material to adjust the liquid contained therein to a predetermined degree. The conventional device, however, has a gap between the inner surface of the container a and the guide roll b. It is, therefore, impossible to apply the dye solution c to the cloth material without leaving any residual quantity of the solution. Thus, there remains a residual quantity of the solution within the container after completion of a dye solution applying process.

In the case of the above stated conventional dye solution impregnating device, 20 to 30 liters of residual solution is left in each dye solution container. However, the dye solution is very expensive and costs about ¥500 per liter. The residual quantity of the dye solution is equivalent to a loss of ¥10,000–15,000 because such residual solution is not usable again. Thus, a large amount of the expensive dye solution has been wasted and also has been presenting a problem as to disposal of such a large amount of the liquid waste.

In an attempt to solve the problem of the conventional device, the present inventors previously proposed a liquid applying device comprising a liquid container which has the sectional form of the bottom thereof in a U-shape; a cloth material guide roll having its outer circumference disposed close to the U-shape curved face of the liquid container leaving a gap of only several millimeters between the outer circumferential face of the roll and the U-shape curved face of the container. This liquid applying device, however, comes to allow immersion of the cloth material in the dye solution for a shorter period of time according as the quantity of dye solution within the container decreases and thus tends to become incapable of uniformly impregnating the cloth material with the dye solution. This problem becomes more serious in the case of a thick cloth material.

The present invention is directed to the solution of the problems hitherto experienced with the conventional and prior art devices.

SUMMARY OF THE INVENTION

It is an object of this invention to provide a liquid impregnating device for cloth materials which is capable of continuously and uniformly impregnating various kinds of cloth materials with a desired liquid, even if the thickness of the cloth materials is varying, and is also capable of having the liquid almost completely absorbed by the cloth material leaving no residual liquid there.

The above and further objects, features and advantages of the invention will become apparent from the following detailed description of embodiments thereof taken in connection with the accompanying drawings.

DETAILED DESCRIPTION OF PREFERRED EMBODIMENTS

Figure 1:
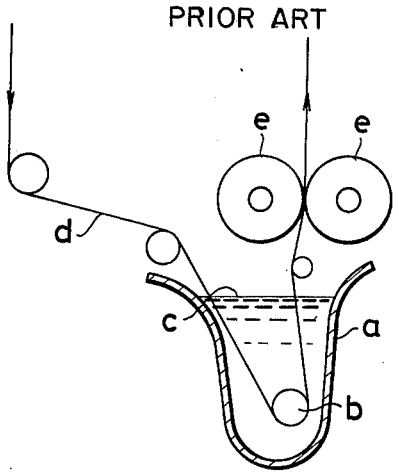
FIG.1 PRIOR ART
FIG. 1 is a schematic illustration of the conventional liquid impregnating device.
Figure 2:
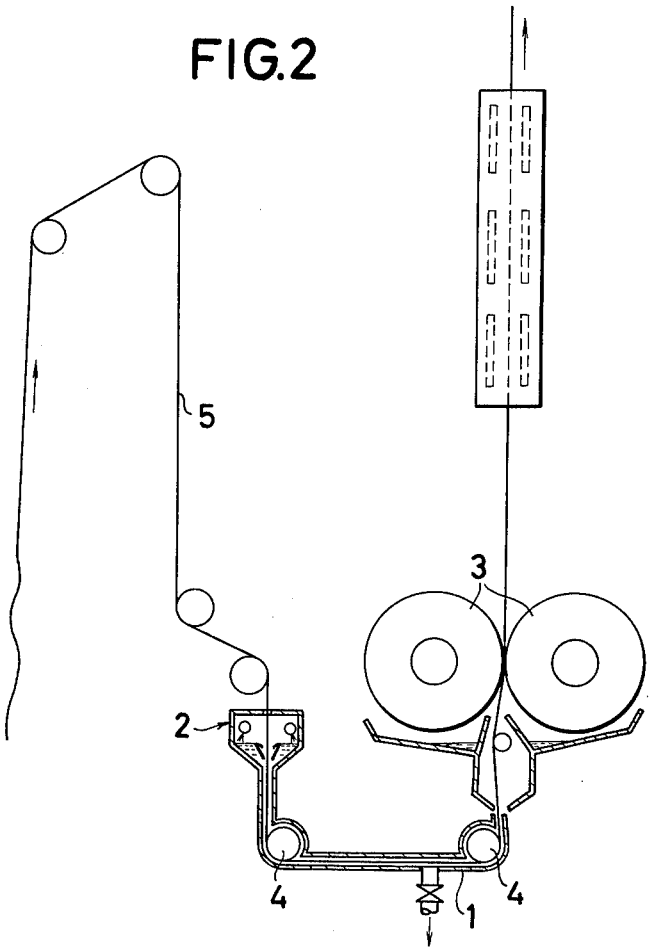
FIG. 2 is a schematic illustration showing a liquid impregnating device embodying the present invention.
Figure 3:
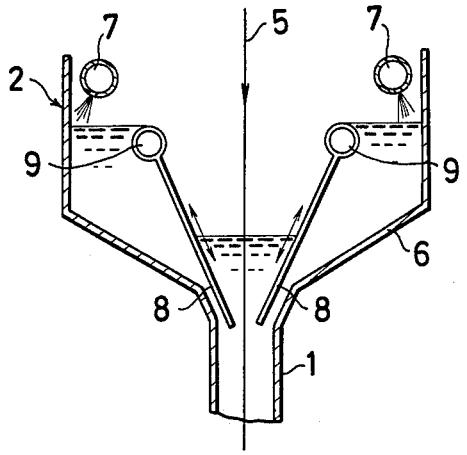
FIG. 3 is an enlarged sectional view showing the liquid supply mechanism of the liquid impregnating device.
Figure 4:
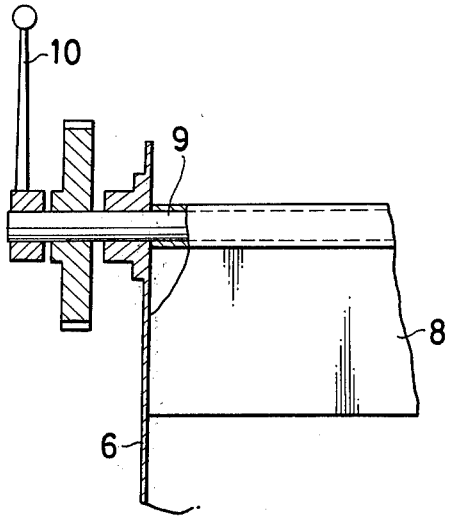
FIG. 4 is a side view showing a part of the liquid supply mechanism.

Referring to FIGS. 2, 3 and 4 which show an embodiment of the invention, there is arranged a cloth material passage 1 to have a side-view form of approximately rectangular flat U-shape. The transverse sectional shape of the cloth material passage is somewhat wider than the breadth of a cloth material to be processed and measures, for example, about 3 mm in longitudinal width. A liquid supply mechanism 2 is formed at the cloth material inlet opening of the cloth material passage 1. At the cloth material outlet opening of the cloth material passage 1, there is provided a pair of wringer rolls 3 which are rotatably arranged to be in pressed contact with each other. At the bent corners of the cloth material passage 1, there are provided cloth material guide rolls 4 for preventing friction between the cloth material 5 and the wall of the cloth material passage. In this particular embodiment example of the invention, parts of the cloth material passage 1 are cut away in such a manner as to have the edge of the cutaway part of the passage 1 in close contact with each of the guide rolls to prevent the liquid from flowing out. However, the present invention is not limited to this arrangement. Instead of providing the cutaway parts, the bent corners of the cloth material passage may be swelled to have the guide rolls placed therein to attain the same purpose.

The structural arrangement of the liquid supply mechanism is as shown in FIGS. 3 and 4. A liquid reservoir 6 is arranged to open into the cloth material passage 1. Above this liquid reservoir, there is provided liquid supply tubes 7 which are respectively disposed on both sides of the cloth material 5 passing through the liquid reservoir 6. In the inside of the liquid reservoir 6, there are provided a pair of weir plates 8 which are arranged to tilt toward each other. Each of these weir plates 8 is carried by a support shafts 9 in such a manner that a variable gap distance is attainable between the pair of the weir plates which are adjustable by turning these support shafts by means of a handle 10 secured to one end of each supporting shaft. Each of the weir plates is thus arranged to be rotatable by operating its handle 10.

Figure 5:
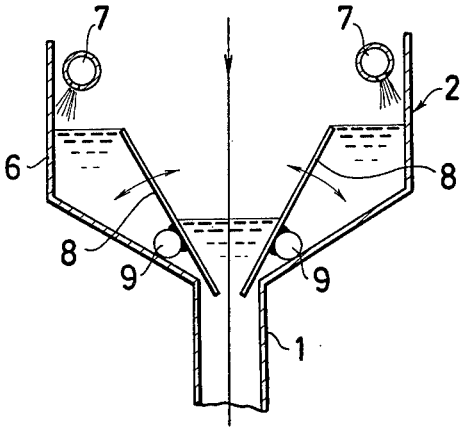
FIG. 5 is a sectional view showing a modification of the liquid supply mechanism as another embodiment of the invention.
Figure 6:
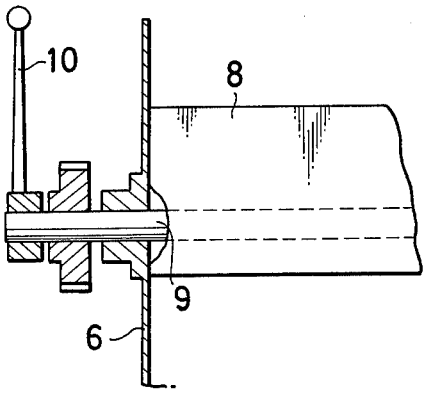
FIG. 6 is a side view showing a part of the liquid supply mechanism shown in FIG. 5.

In the embodiment described in the foregoing, the supporting shafts 9 are secured to the upper ends of the weir plates 8. However, the present invention is not limited to this arrangement and the supporting shafts 9, for example, may be disposed at the lower ends of the weir plates 8 as shown in FIGS. 5 and 6.

The operation of this embodiment is as follows. The cloth material 5 is passed through the cloth material passage 1. Following this, a desired liquid is gradually supplied to the inside of the cloth material passage 1 from the liquid supply tubes 7 through the liquid reservoir 6 in such a way as not to have the liquid overflow from the liquid reservoir 6. Then, the cloth material 5 is allowed to move on through the liquid with which the cloth material passage is filled. The cloth material 5 is sufficiently impregnated with the liquid when it comes out of the cloth material passage 1. After that, the cloth material 5 is squeezed by the wringer rolls 3 to have the liquid wrung out to a certain degree before it is allowed to move on for a next process to be carried out thereon.

Figure 7:
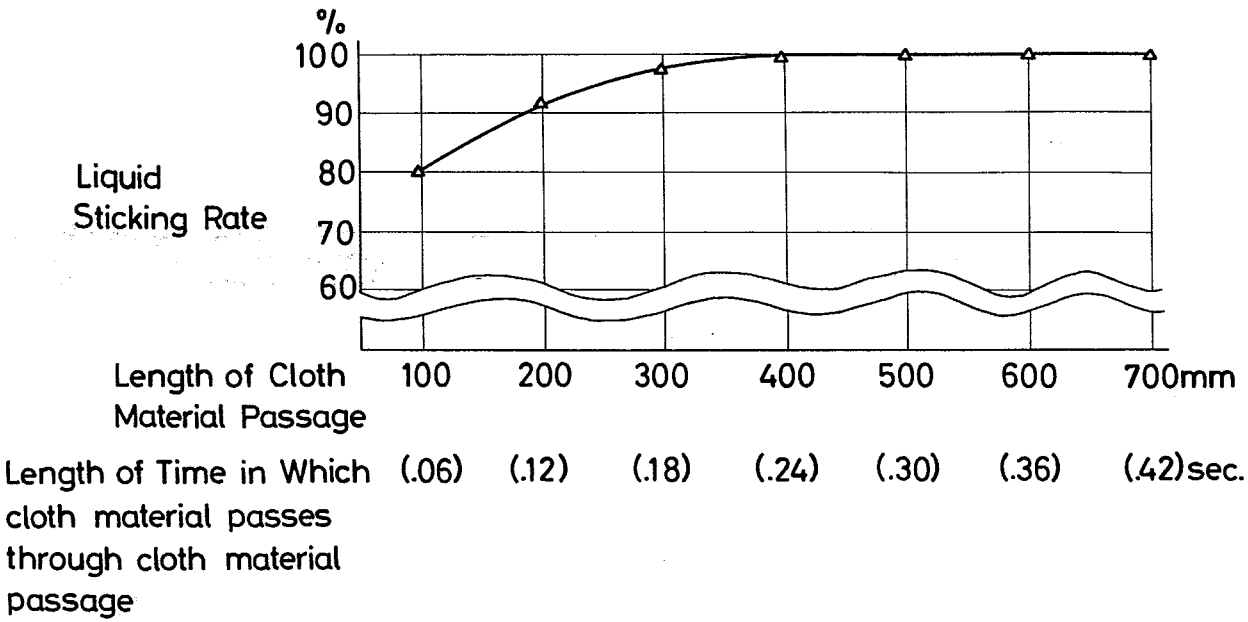
FIG. 7 is a graphical representation showing the relation of the length of a cloth material passage to a liquid sticking rate.

To sufficiently and homogeneously impregnate the cloth material 5 with the liquid while the cloth material 5 is passing through the passage 1, the length of the cloth material passage 1 and the speed at which the cloth material 5 is allowed to travel must be taken into consideration. With regard to this, tests were conducted by the inventors to obtain results as shown in FIG. 7. Referring now to FIG. 7, the tests were conducted in the following manner:

1. Cloth materials used for the tests (scoured and bleached materials):

| | | |
|---|---|---|
| a. | "Katsuragi-Ori" twill cloth material, 100% cotton | 330 g/m$^2$ |
| b. | Blended yarn cloth material, tropical, 65% polyester, 35% cotton | 170 g/m$^2$ |
| c. | Twill cloth material, 100% polyester processed yarn | 190 g/m$^2$ |

2. Dye solution used for the tests:

| | |
|---|---|
| a. Cloth material of 100% cotton 3% solution of direct cotton dye | 30° C. |
| b. Cloth material of 100% polyester and polyester/cotton blended material: 3% solution of disperse dye | 30° C. |

3. Squeezing:

2 rubber rolls, 10 ton mangle (hardness 80), applied pressure: 2 kg/cm$^2$ $$\text{Liquid sticking rate} = \frac{\text{Sticking quantity}}{\text{saturated sticking quantity}} \times 100$$

Saturated sticking quantity:
Maximum quantity of sticking liquid after immersion and squeezing As indicated in FIG. 7, it is preferable that the cloth material passage 1 measures at least 400 mm in length and that the cloth material 5 is arranged to travel at a speed taking at least 0.24 sec. for passing through the passage 1.

Further, the arrangement to have the weir plates 8 disposed on both sides of the cloth material 5 at the inlet opening of the cloth material passage 1 and to allow the cloth material thus to pass through a gap between the two weir plates 8 together with the liquid causes the liquid to be forcedly pushed into the cloth material passage 1. Besides, this gap between the two weir plates 8 is arranged to be adjustable by operating the handles as desired in accordance with the thickness of the cloth material 5 to be processed. Therefore, the invented device permits to uniformly impregnate various kinds of cloth materials without fail.

Since the volume of the inside of the cloth material passage 1 is arranged to be as small as possible, the liquid within the cloth material passage 1 is almost completely absorbed by the cloth material, thus leaving not much residual liquid there. Therefore, the liquid can be prevented from being wasted at the time of replacement thereof. This also eliminates the possibility of environmental contamination otherwise caused by a waste liquid.

Figure 8:
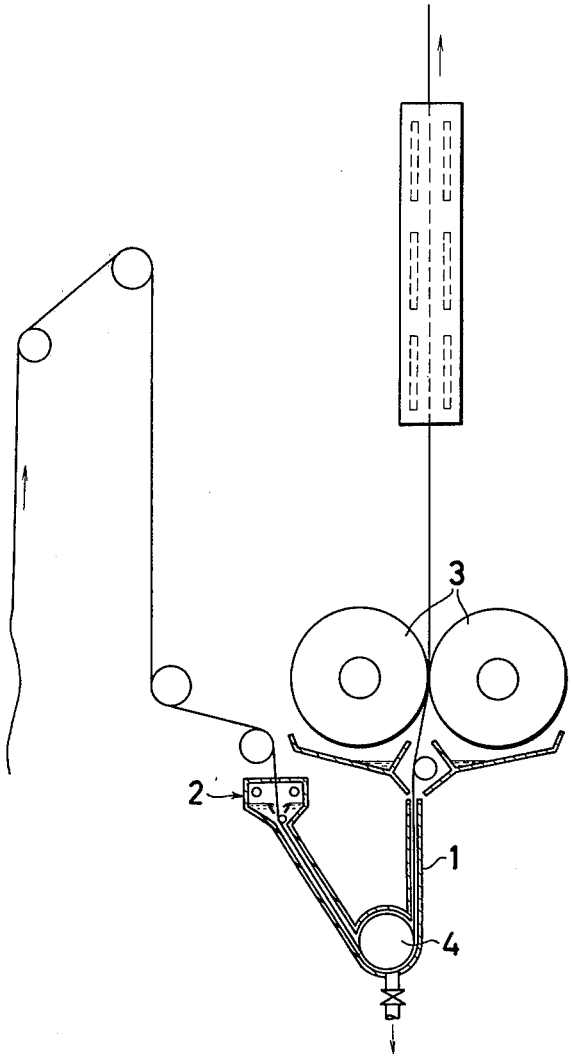
FIG. 8 is a schematic illustration, partly in section, of still another embodiment of the present invention.

In the embodiment described in the foregoing, the cloth material passage 1 is arranged to have a side-view form of an approximately rectangular flat U shape. However, in accordance with the present invention, the form of the cloth material passage 1 is not limited to this shape but may be arranged into other shapes such as an approximate U shape as shown in FIG. 8. However, it is preferable that the cloth material passage 1 measures at least 400 mm in length and that the height of the passage is as low as possible and is preferably set at 3 mm or thereabout.

What is claimed is:

1. A device for continuously impregnating a cloth material with a liquid, said device comprising:

a tubular cloth material passage measuring at least 400 mm in length, said passage being provided with an opening which is slightly wider than the breadth of the cloth material to be processed in transverse width and measures about 3 mm in longitudinal width, said passage having a cloth material inlet and a cloth material outlet;

a liquid supply mechanism adjoining the cloth material inlet of said cloth material passage including a liquid reservoir in communication with said cloth material passage;

wringer rolls provided in the vicinity of the cloth material outlet of said cloth material passage; and a pair of weir plates disposed within said liquid reservoir in said liquid supply mechanism, each of said weir plates being arranged on an opposite side of said cloth material passing through said liquid reservoir, said weir plates forming a gap therebetween through which said cloth material passes on its way to said passage, and means for adjusting said weir plates relative to one another for varying said gap between said weir plates.

* * * * *